US011235943B2

(12) United States Patent
Sugiyama et al.

(10) Patent No.: US 11,235,943 B2
(45) Date of Patent: Feb. 1, 2022

(54) POST-PROCESSING APPARATUS AND IMAGE FORMING SYSTEM

(71) Applicant: FUJIFILM BUSINESS INNOVATION CORP., Tokyo (JP)

(72) Inventors: Kazue Sugiyama, Kanagawa (JP); Yoshiaki Hanyu, Kanagawa (JP); Yoshikazu Ikeda, Kanagawa (JP); Takaaki Saruki, Kanagawa (JP); Kota Miyamoto, Kanagawa (JP); Kenichi Uchida, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/060,997

(22) Filed: Oct. 1, 2020

(65) Prior Publication Data

US 2021/0269273 A1 Sep. 2, 2021

(30) Foreign Application Priority Data

Mar. 2, 2020 (JP) ..... JP2020-034921

(51) Int. Cl.
*B65H 37/06* (2006.01)
*B65H 29/70* (2006.01)

(52) U.S. Cl.
CPC ..... *B65H 37/06* (2013.01); *B65H 29/70* (2013.01)

(58) Field of Classification Search
CPC . B65H 29/70; B65H 37/06; B65H 2301/5121
See application file for complete search history.

(56) References Cited

U.S. PATENT DOCUMENTS 5,539,511 A * 7/1996 Wenthe, Jr. ..... B65H 29/12 162/270
10,023,424 B2 7/2018 Awano
2007/0135288 A1* 6/2007 Matsumoto ..... B65H 45/14 493/459
2017/0090391 A1* 3/2017 Awano ..... B65H 45/20
2017/0261908 A1* 9/2017 Tsunoda ..... G03G 15/6576

FOREIGN PATENT DOCUMENTS

JP 3722494 B2 11/2005
JP 2017-061385 A 3/2017

* cited by examiner

*Primary Examiner* — Jennifer Bahls
(74) *Attorney, Agent, or Firm* — Oliff PLC

(57) ABSTRACT

A post-processing apparatus includes memory and a processor configured to control a curving device that curves a sheet, which is transported to the curving device, by pressing the sheet, control folding processing that is performed on a sheet curved by the curving device, and control, when folding processing is performed such that two ends of a sheet in a transport direction of the sheet face outward in opposite directions after the folding processing has been performed on the sheet, the curving device so as to curve the sheet in plural directions with respect to a transport surface.

20 Claims, 19 Drawing Sheets

(10-PAGE ZIG-ZAG FOLD)

POST-PROCESSING APPARATUS AND IMAGE FORMING SYSTEM

CROSS-REFERENCE TO RELATED APPLICATIONS

This application is based on and claims priority under 35 USC 119 from Japanese Patent Application No. 2020-034921 filed Mar. 2, 2020.

BACKGROUND

(i) Technical Field

The present disclosure relates to a post-processing apparatus and an image forming system.

(ii) Related Art

Japanese Unexamined Patent Application Publication No. 2017-061385 discloses a sheet processing apparatus that corrects a sheet having a convex upper surface such that the sheet has a convex lower surface by using a decurler and then feeds the sheet to a folding function unit so as to suppress a folding failure from occurring when the sheet is letter-folded.

Japanese Patent No. 3722494 discloses an image forming apparatus that changes, when the curl of a sheet is corrected, the degree of curl correction so as to accommodate variations in the area coverage on the sheet.

When folding processing is performed by using a post-processing apparatus that has a folding function, there is a case where folding processing for folding sheets into half fold, tri-fold, or the like is performed after the sheets have been curled in one direction in order to improve the ability of each of the sheets, which have been folded, to be accommodated and the states of the sheets stacked on top of one another.

However, in the case of a folding method such as a Z-fold method by which a sheet is folded such that the two ends of the sheet face outward in opposite directions, if sheets are curled in one direction, end portions of sheets are curved in a plurality of directions after the sheets have been folded, and as a result, the states of these sheets stacked on top of one another become unfavorable.

SUMMARY

Aspects of non-limiting embodiments of the present disclosure relate to providing a post-processing apparatus and an image forming system capable of improving the ability of a sheet, which has been folded such that the two ends of the sheet face outward in opposite directions, to be accommodated compared with the case where the sheet is curled in one direction.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a post-processing apparatus including memory and a processor configured to control a curving device that curves a sheet, which is transported to the curving device, by pressing the sheet, control folding processing that is performed on a sheet curved by the curving device, and control, when folding processing is performed such that two ends of a sheet in a transport direction of the sheet face outward in opposite directions after the folding processing has been performed on the sheet, the curving device so as to curve the sheet in plural directions with respect to a transport surface.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will be described in detail below with reference to the drawings.

Figure 1:
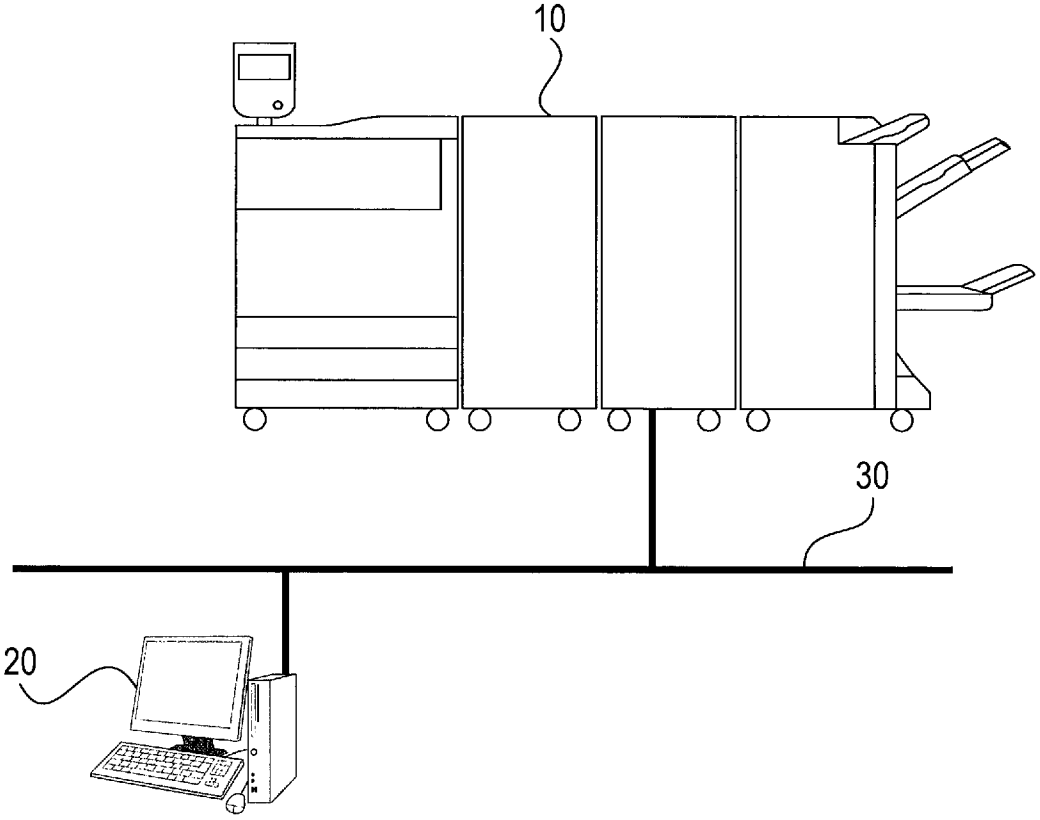
FIG. 1 is a diagram illustrating a system configuration of a printing system according to the exemplary embodiment of the present disclosure.

FIG. 1 is a diagram illustrating a system configuration of a printing system according to the exemplary embodiment of the present disclosure.

As illustrated in FIG. 1, the printing system according to the exemplary embodiment of the present disclosure includes an image forming system 10 and a terminal apparatus 20 that are connected to each other via a network 30. The terminal apparatus 20 generates print data and transmits the generated print data to the image forming system 10 via the network 30. The image forming system 10 receives print data transmitted by the terminal apparatus 20 and outputs an image that corresponds to the print data onto a sheet.

Figure 2:
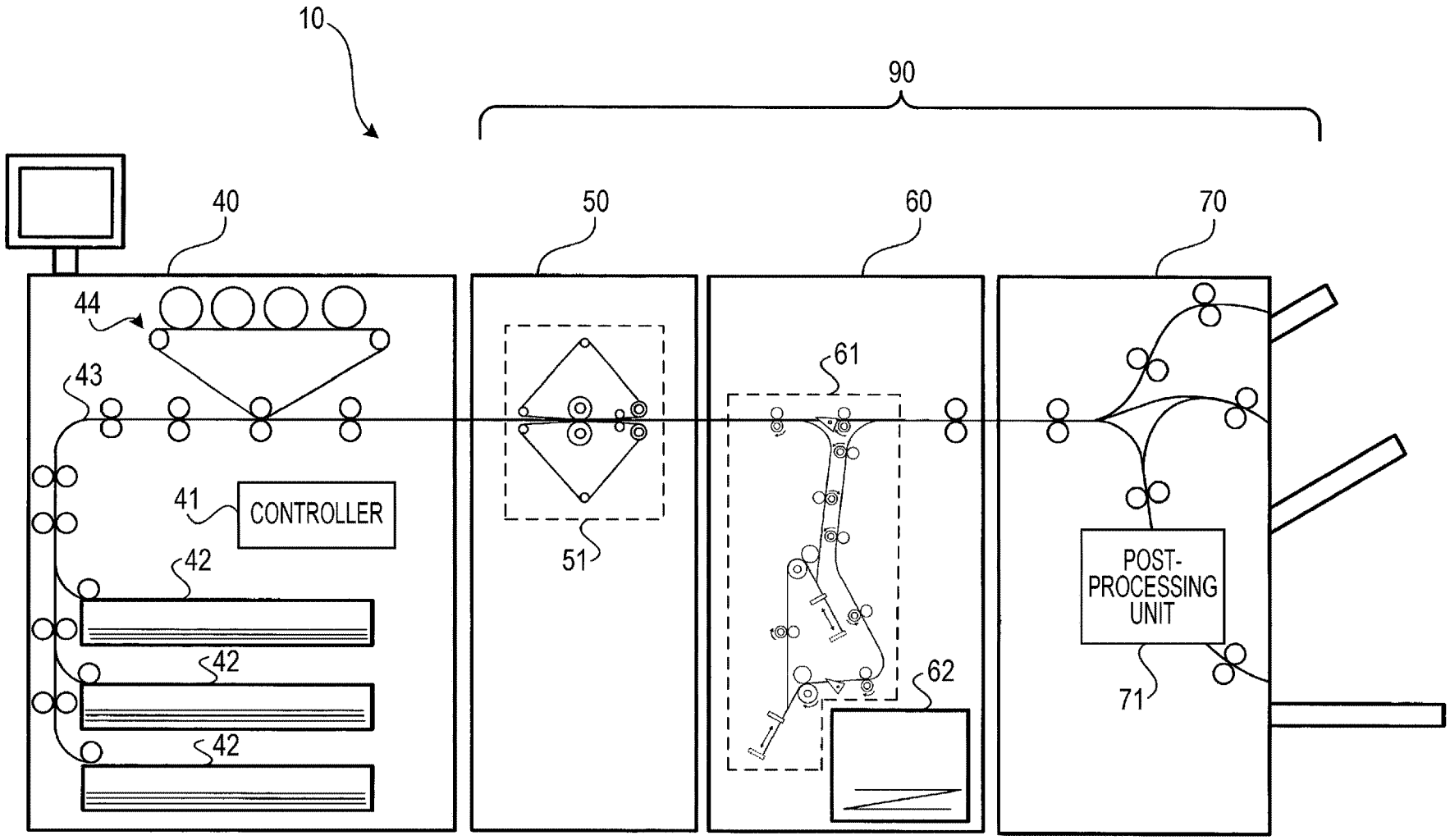
FIG. 2 is a diagram illustrating a configuration of an image forming system according to the exemplary embodiment of the present disclosure.

Next, the configuration of the image forming system 10 of the present exemplary embodiment will be described with reference to FIG. 2.

The image forming system 10 of the present exemplary embodiment includes an image forming apparatus 40 and a post-processing apparatus 90. The post-processing apparatus 90 includes a decurling device 50, a folding device 60, and a finisher 70.

The image forming apparatus 40 includes a controller 41 that controls printing processing in the image forming apparatus 40 and various types of post-processing in the post-processing apparatus 90, a plurality of sheet supply cassettes 42, a transport path 43 along which sheets supplied from the sheet supply cassettes 42 are transported, and an image forming section 44 that forms an image for each print job onto a sheet transported along the transport path 43.

The image forming section 44 includes photoconductors that are arranged side by side and each of which corresponds to one of yellow, magenta, cyan, and black and an intermediate transfer belt. A charging device, an exposure device, a developing device, a first transfer device, a cleaning device, and so forth (not illustrated) are disposed around each of the photoconductors, and toner images that are formed on the photoconductors are transferred onto the intermediate transfer belt. Toner images on the intermediate transfer belt are transferred by a second transfer roller onto a sheet, such as a recording medium, that is transported along the transport path 43, and the toner images are fixed onto the sheet by a fixing device. Then, the sheet to which the toner images have been fixed is transported to the post-processing apparatus 90.

Note that the image forming system 10 may have a configuration in which an independent decurling device 50 is not provided and in which a decurling unit 51 is disposed in the image forming apparatus 40.

The decurling device 50 includes the decurling unit 51, which is disposed therein, and is a curving device that curves a sheet transported from the image forming apparatus 40 by pressing the sheet. Note that the decurling device 50 is used not only for simply curving and curling a sheet but also for performing curl correction that reduces or eliminates the curl of a sheet by pressing the sheet.

The detailed configuration and the detailed operation of the decurling unit 51 that performs processing for curving a sheet in the decurling device 50 will be described later.

The folding device 60 includes a folding processing unit 61 and a sheet-stacking device 62, which are disposed in the folding device 60, and performs folding processing on a sheet that is curled, or bent by the decurling device 50. A sheet that is folded by the folding processing unit 61 is ejected to the sheet-stacking device 62. Note that, depending on the folding pattern of a sheet, there is a case where a sheet folded by the folding processing unit 61 is returned to the transport path 43, transported to the finisher 70, and ejected to an ejection tray.

The finisher 70 includes a post-processing unit 71, which is disposed therein, and performs various types of post-processing such as binding into a booklet, stapling, and punching on sheets transported from the folding device 60.

Figure 3:
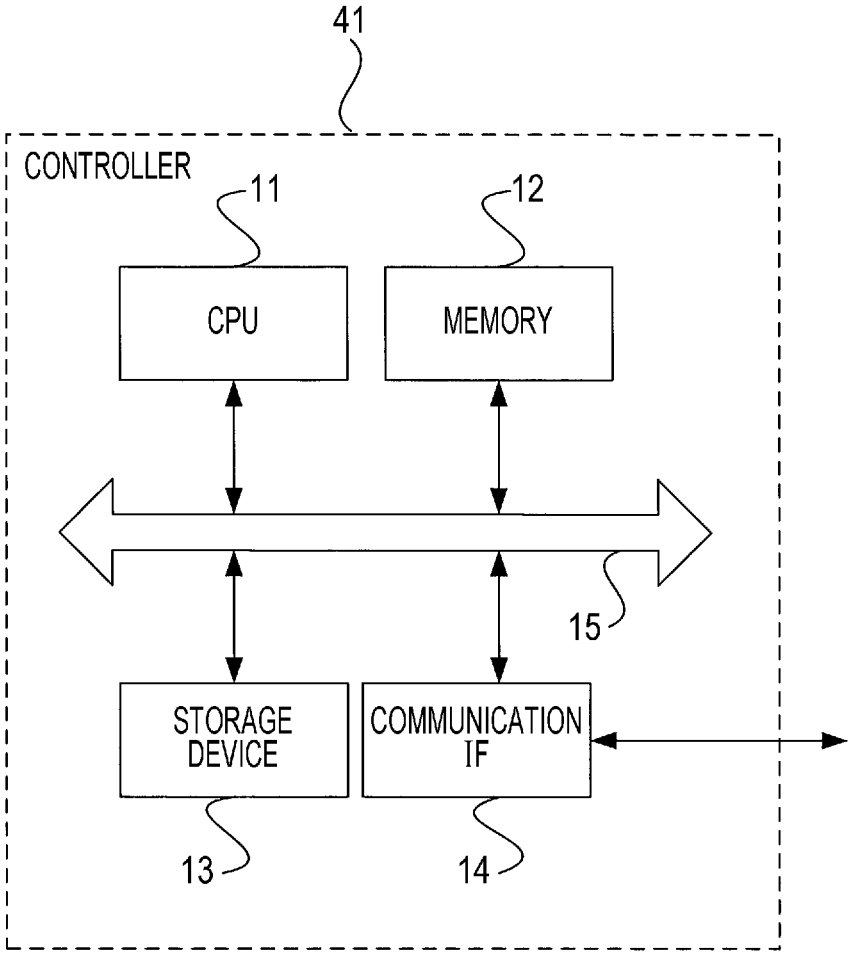
FIG. 3 is a diagram illustrating a hardware configuration of a controller.

The hardware configuration of the controller 41 will now be described with reference to FIG. 3. As illustrated in FIG. 3, the controller 41 includes a CPU 11, memory 12, a storage device 13 such as a hard disk drive, and a communication interface (hereinafter abbreviated to IF) 14 that performs transmission and reception of data with, for example, an external device. These components are connected to one another via a control bus 15.

The CPU 11 is a processor that controls the operation of the controller 41 by performing predetermined processing on the basis of a control program stored in the memory 12 or the storage device 13. Note that, in the present exemplary embodiment, although the CPU 11 is configured to read and run a control program stored in the memory 12 or the storage device 13, the program may be provided to the CPU 11 by being stored in a storage medium such as a compact disc read-only memory (CD-ROM).

The controller 41 controls the operations of the image forming apparatus 40, the decurling device 50, the folding device 60, and the finisher 70 so as to perform printing processing for forming an image onto a sheet on the basis of a print instruction transmitted from the terminal apparatus 20 and performs control in such a manner that the decurling device 50, the folding device 60, and the finisher 70 perform various types of post-processing specified by the print instruction.

In other words, the controller 41 controls the printing processing that is performed in the image forming apparatus 40, controls the decurling device 50 that curves a sheet transported from the image forming apparatus 40 by pressing the sheet, and controls the folding device 60 that performs folding processing on a sheet curved by the decurling device 50. In addition, the controller 41 controls the finisher 70 that performs post-processing on a sheet transported from the folding device 60.

Note that a configuration may be employed in which the decurling device 50, the folding device 60, and the finisher 70 each include a controller that controls the operation thereof, or a configuration may be employed in which a single controller that controls the operations of the decurling device 50, the folding device 60, and the finisher 70 is disposed at an arbitrary position in the post-processing apparatus 90.

Next, the structure of the decurling unit 51 disposed in the decurling device 50 will be described with reference to FIG. 4.

Figure 4:
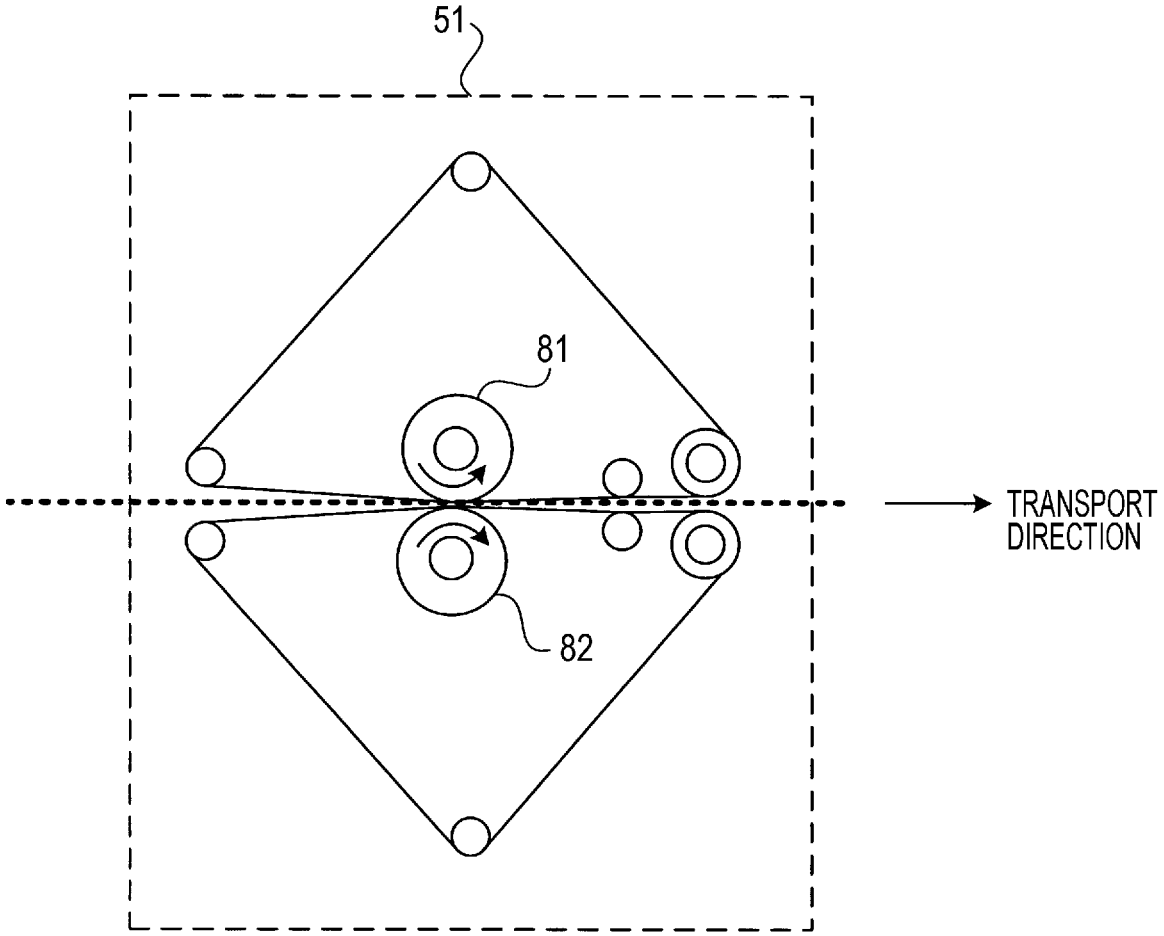
FIG. 4 is a diagram illustrating a structure of a decurling unit disposed in a decurling device.

The decurling unit 51 has a configuration such as that illustrated in FIG. 4 and includes two pressing rollers 81 and 82 that are arranged with the transport path 43, along which sheets are transported from the image forming apparatus 40, interposed therebetween.

Belts on each of which tension is exerted by a tension roller and the like are provided between the pressing roller 81 and the transport path 43 and between the pressing roller 82 and the transport path 43, and the pressing rollers 81 and 82 are configured to apply pressure to a sheet on the transport path 43 via these belts.

The pressing rollers 81 and 82 are capable of moving up and down in accordance with a direction in which a sheet is to be curled, that is, a direction of the curvature of a sheet. More specifically, when a sheet is curled downward such that the two ends of the sheet in a transport direction of the sheet face downward, the pressing rollers 81 and 82 move in an upward direction, and when a sheet is curled upward such that the two ends of the sheet in the transport direction of the sheet face upward, the pressing rollers 81 and 82 move in a downward direction.

Figure 5:
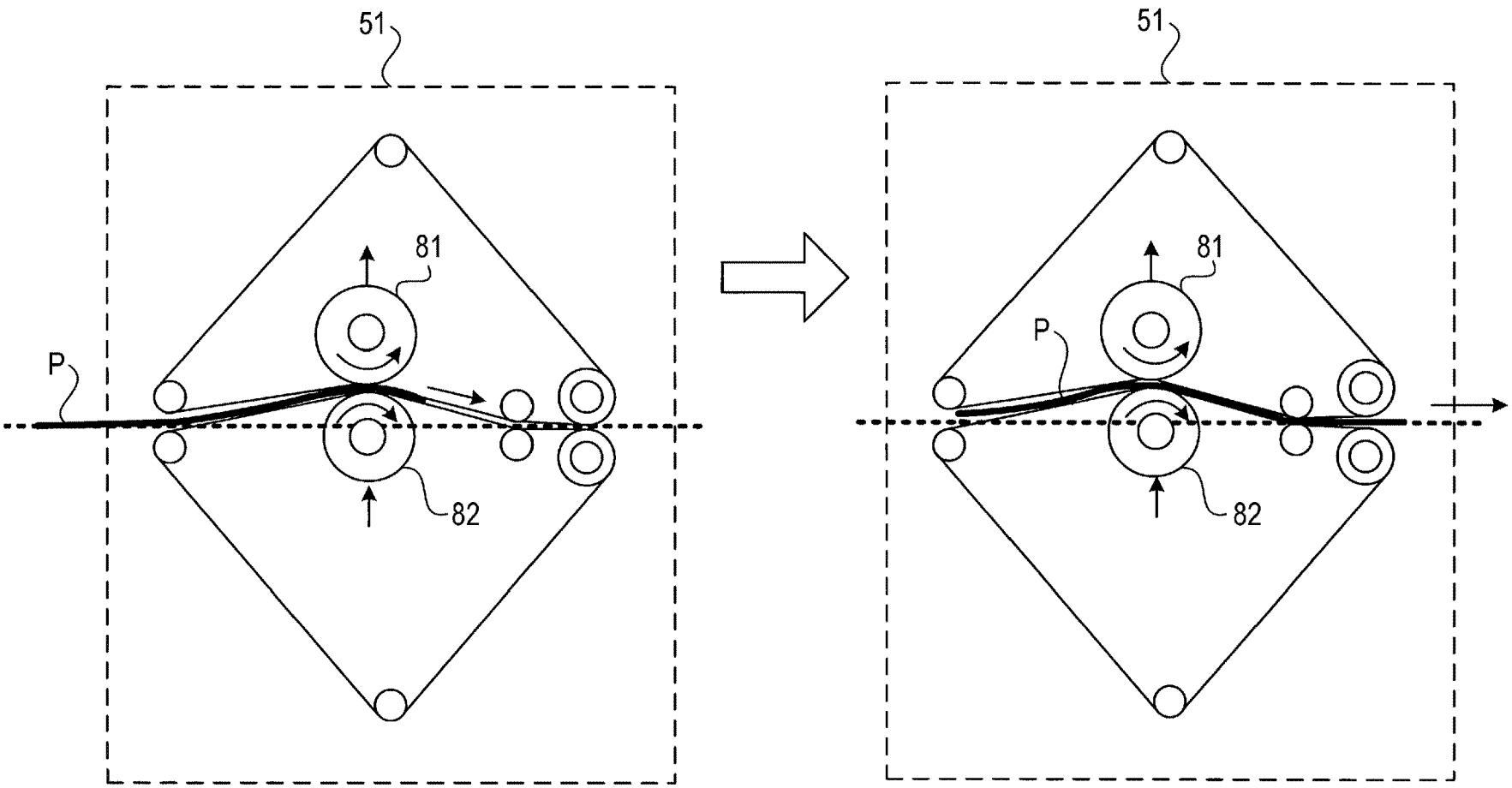
FIG. 5 is a diagram illustrating an operation that is performed when a sheet is curled downward by the decurling unit.

An operation in the case of curling a sheet downward by using the decurling unit 51 will now be described with reference to FIG. 5.

In the case of curling a sheet downward, the pressing rollers 81 and 82 in the decurling unit 51 are moved in the upward direction by a distance that corresponds to the degree of curl to be given to the sheet. In this state, the sheet transported from the image forming apparatus 40 passes between the pressing rollers 81 and 82, so that the sheet is transported while being kept pressed in the upward direction. As a result, the sheet transported from the decurling unit 51 to the folding device 60 is curled such that the two ends of the sheet face downward.

Figure 6:
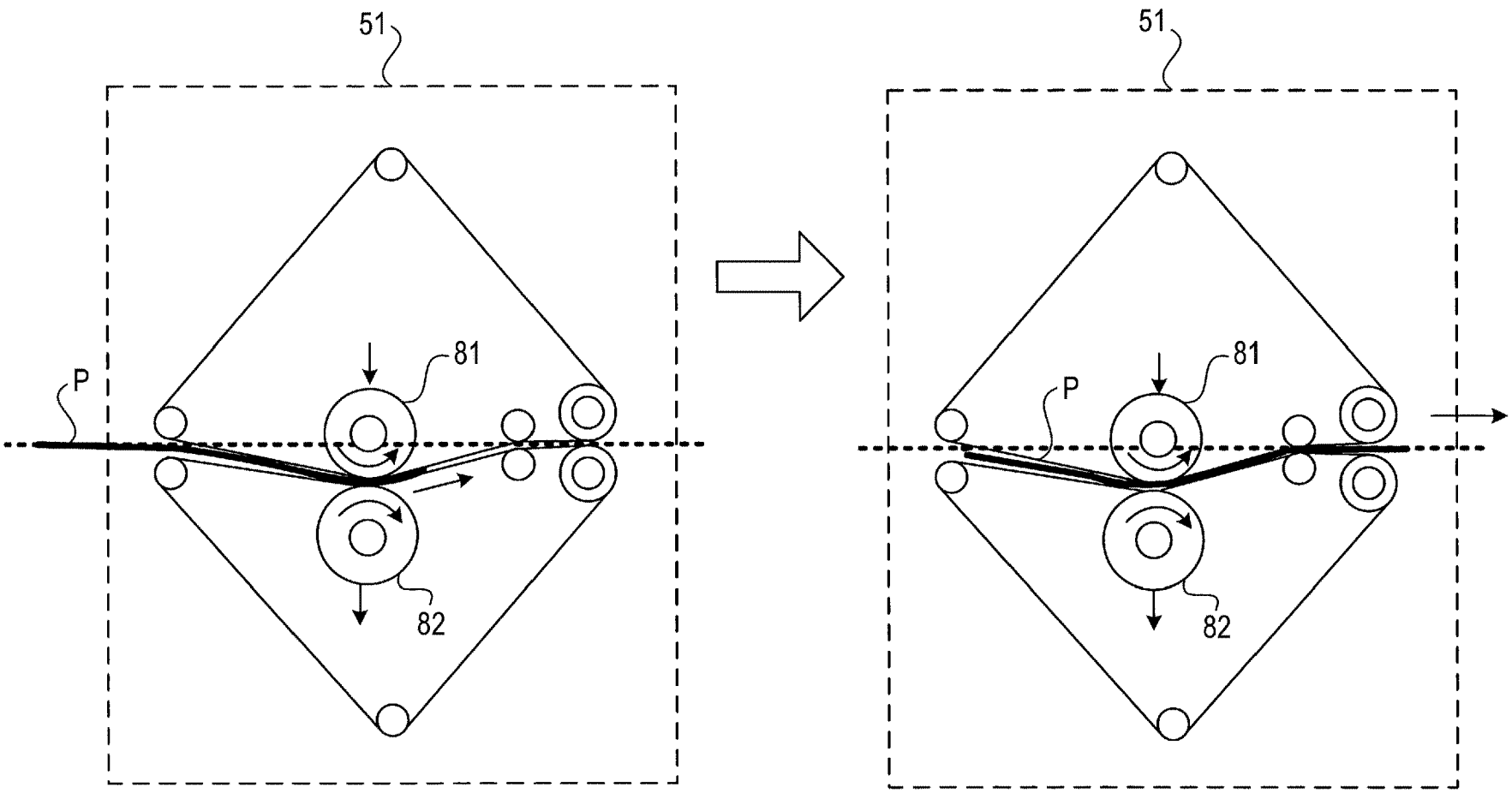
FIG. 6 is a diagram illustrating an operation that is performed when a sheet is curled upward by the decurling unit.

Next, an operation in the case of curling a sheet upward by using the decurling unit 51 will be described with reference to FIG. 6.

In the case of curling a sheet upward, the pressing rollers 81 and 82 in the decurling unit 51 are moved in the downward direction by a distance that corresponds to the degree of curl to be given to the sheet. In this state, the sheet transported from the image forming apparatus 40 passes between the pressing rollers 81 and 82, so that the sheet is transported while being kept pressed in the downward direction. As a result, the sheet transported from the decurling unit 51 to the folding device 60 is curled such that the two ends of the sheet face upward.

An example of a sheet P that is curled downward in the manner described above is illustrated in FIG. 7A. An example of a sheet P that is curled upward in the manner described above is illustrated in FIG. 7B. Note that, in each of FIG. 7A and FIG. 7B, the sheet P is illustrated by exaggerating the degree of curl given to the sheet P for ease of understanding of the following description, and the degree of the actual curl of the sheet P is smaller than each of those illustrated in each of FIG. 7A and FIG. 7B. This is common to the following description.

Folding processing that is performed by the folding device 60 will now be described. First, folding patterns of sheets that are folded by the folding processing unit 61 of the folding device 60 will be described with reference to FIG. 8.

Figure 8:
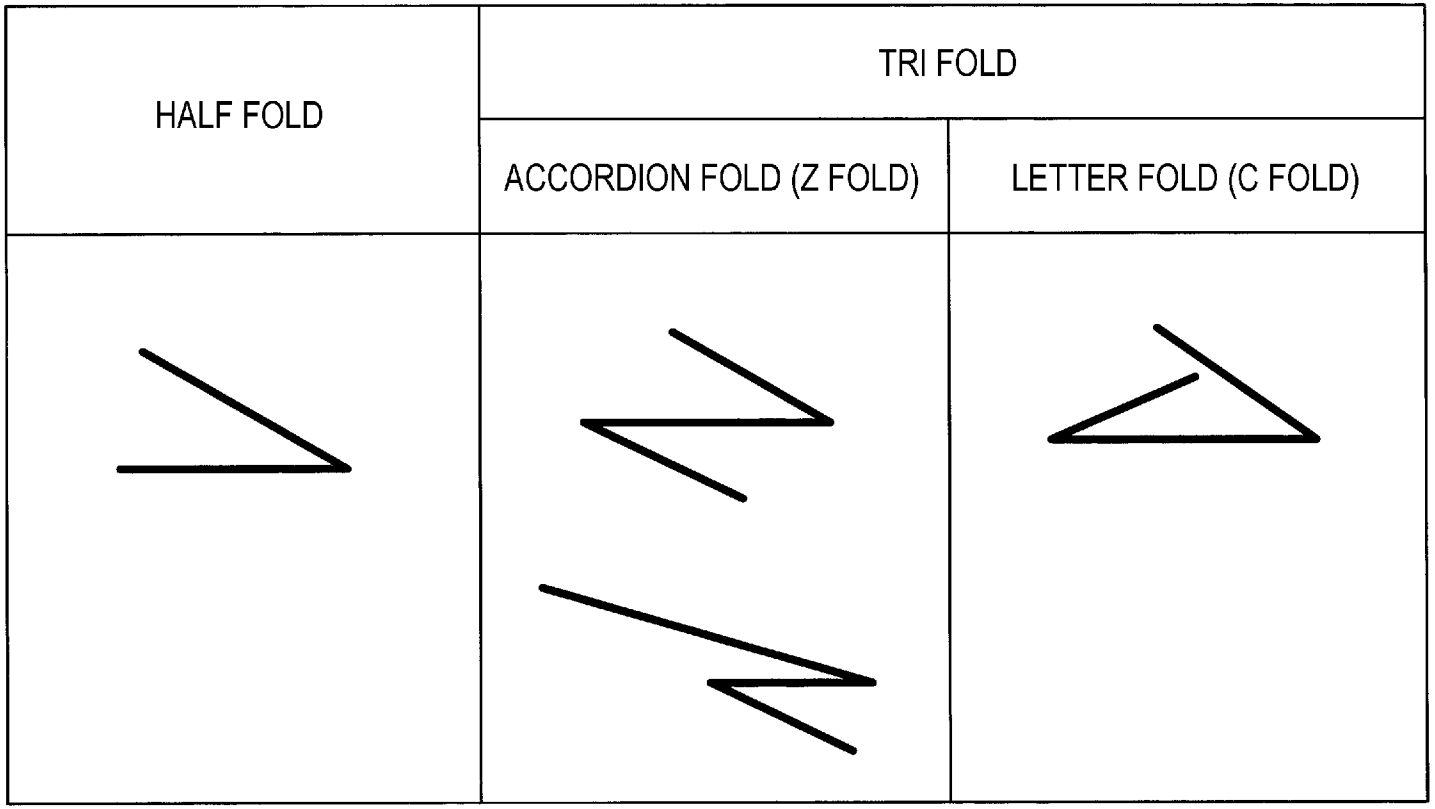
FIG. 8 is a diagram illustrating folding patterns of sheets that are folded by a folding processing unit of a folding device.

Note that FIG. 8 illustrates representative folding patterns that are formable by the folding processing unit 61. First, the folding patterns are broadly divided into half fold and tri-fold.

The half fold is a folding method of folding a sheet once at its center. Note that, in the case of the half fold, although the folding direction in which a sheet is folded such that a printing surface thereof is located on the inner side and the folding direction in which a sheet is folded such that a printing surface thereof is located on the outer side are different from each other, a printing surface will not be taken into consideration in the following description.

The tri-fold is a folding method of folding a sheet at two positions. The tri-fold includes two folding methods which are an accordion fold and a letter fold. The accordion fold is a folding method of folding a sheet such that the two ends of the sheet face outward in opposite directions, and the letter fold is a folding method of folding a sheet such that one of the two ends of the sheet is positioned further inside than the other end. The accordion fold is also called a Z fold, and a sheet that is accordion-folded is Z-shaped in cross-section or in an end view. The letter fold is also called a C fold, and a sheet that is letter-folded is C-shaped in cross-section or in an end view.

Note that the accordion fold, which is also called Z fold, includes a folding method of folding a sheet at positions where the sheet is divided into three equal portions and a folding method of folding a sheet at positions where the sheet is divided into three unequal portions.

Figure 9:
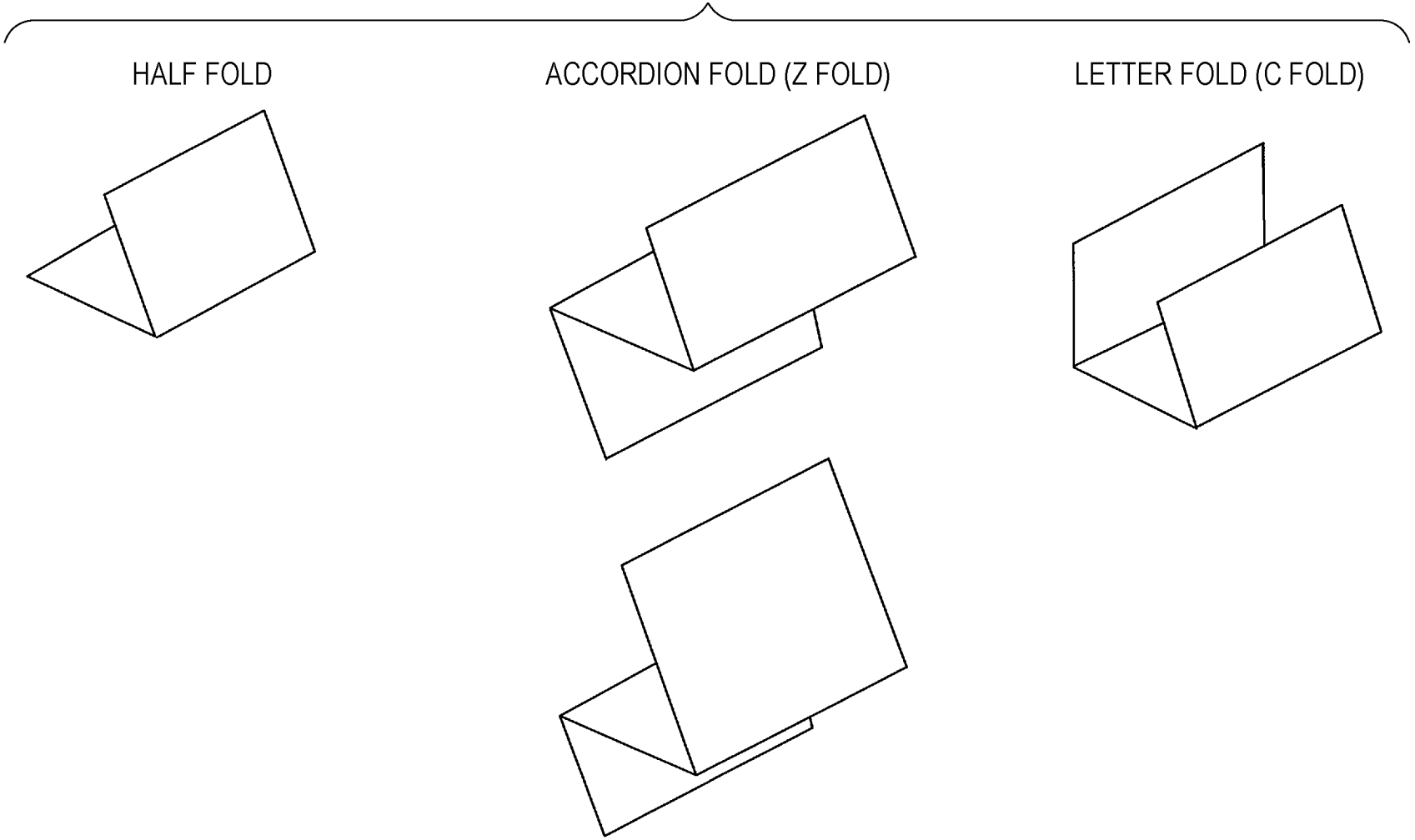
FIG. 9 is perspective views of sheets each of which is folded by one of the folding methods illustrated in FIG. 8.

FIG. 9 illustrates perspective views of sheets each of which is folded by one of the folding methods illustrated in FIG. 8.

When folding processing is performed by using the folding device 60, there is a case where folding processing for folding sheets into half fold, tri-fold, or the like is performed after the sheets have been curled in one direction in order to improve the ability of each of the sheets, which have been folded, to be accommodated and the states of the sheets stacked on top of one another.

The case where a sheet curled in one direction is half-folded will now be described with reference to FIG. 10.

Figure 7A:
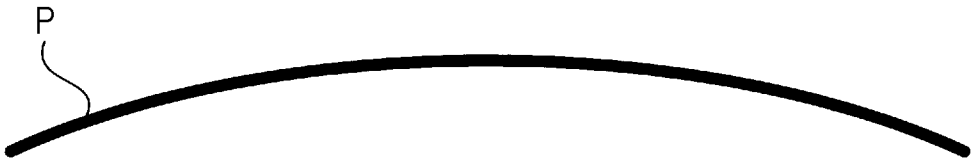
FIGS. 7A and 7B are respectively a diagram illustrating an example of a downwardly curled sheet and a diagram illustrating an example of an upwardly curled sheet.
Figure 7B:
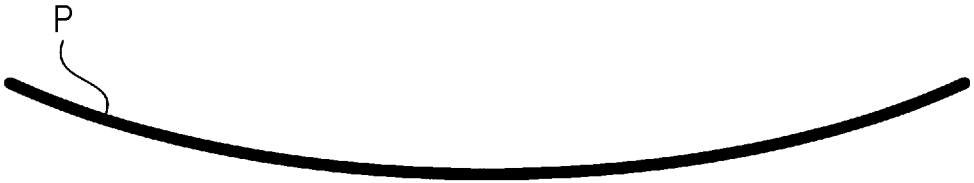
Figure 10:
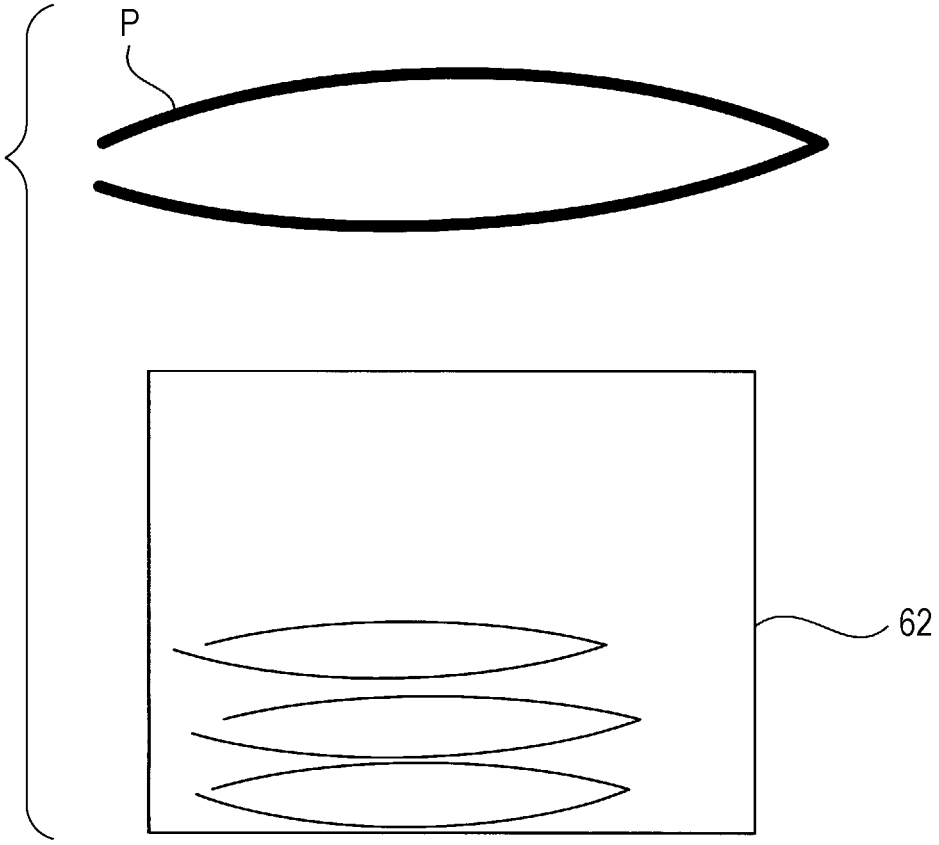
FIG. 10 is a diagram illustrating a state in which a sheet curled in one direction is half-folded.

FIG. 10 illustrates the case where a sheet that has been curled in one direction such as that illustrated in FIG. 7A or 7B is half-folded. It is understood from FIG. 10 that the two surfaces of the sheet, which is half-folded, are each curved outward. Thus, in such a state, a force is applied to the sheet in a direction in which the sheet is closed.

Consequently, when sheets that are half-folded in the manner described above are ejected to the sheet-stacking device 62, the sheets maintain their favorable ability to be accommodated, and the sheets stacked on top of one another are maintained in a favorable state.

Here, the ability to be accommodated refers to the ease with which a folded sheet may be accommodated in the sheet-stacking device 62, and when a folded sheet has a favorable ability to be accommodated, the folded sheet is not likely to be opened, that is, a force is applied to the folded sheet in the direction in which the sheet is closed. Since such a folded sheet is not likely to be opened, even when a plurality of folded sheets are stacked on top of one another, the sheets are stably stacked on top of one another, and this implies that a large number of sheets may be stacked on top of one another in the sheet-stacking device 62, the ejection tray, or the like. In addition, when folded sheets each have a favorable ability to be accommodated, this implies that the sheets are tidily accommodated, and thus, the states of the sheets stacked on top of one another are improved by improving each of the sheet's ability to be accommodated.

Next, the case where a sheet curled in one direction is letter-folded will be described with reference to FIG. 11.

Figure 11:
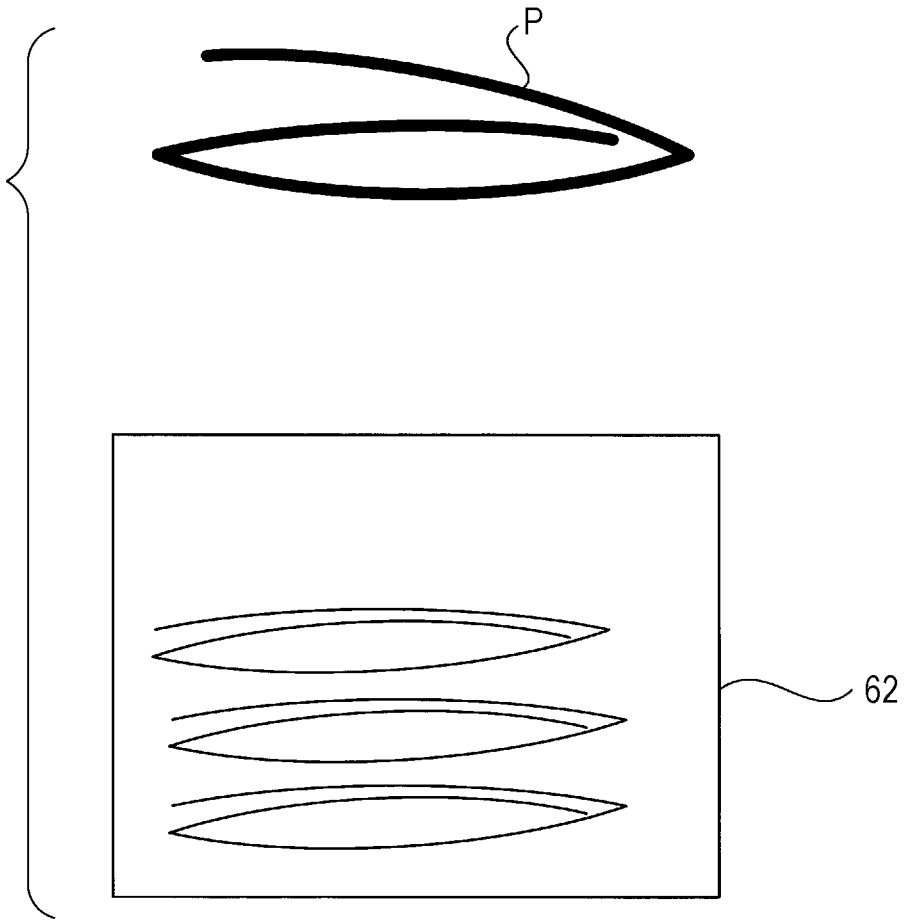
FIG. 11 is a diagram illustrating a state in which a sheet curled in one direction is letter-folded.

FIG. 11 illustrates the case where a sheet that has been curled in one direction such as that illustrated in FIG. 7A or 7B is letter-folded. It is understood from FIG. 11 that all the surfaces of the letter-folded sheet are curved outward. Thus, in such a state, a force is applied to the sheet in a direction in which the sheet is closed.

Consequently, when sheets that are letter-folded in the manner described above are ejected to the sheet-stacking device 62, the sheets maintain their favorable ability to be accommodated, and the sheets stacked on top of one another are maintained in a favorable state.

The case where a sheet curled in one direction is accordion-folded will now be described with reference to FIG. 12.

Figure 12:
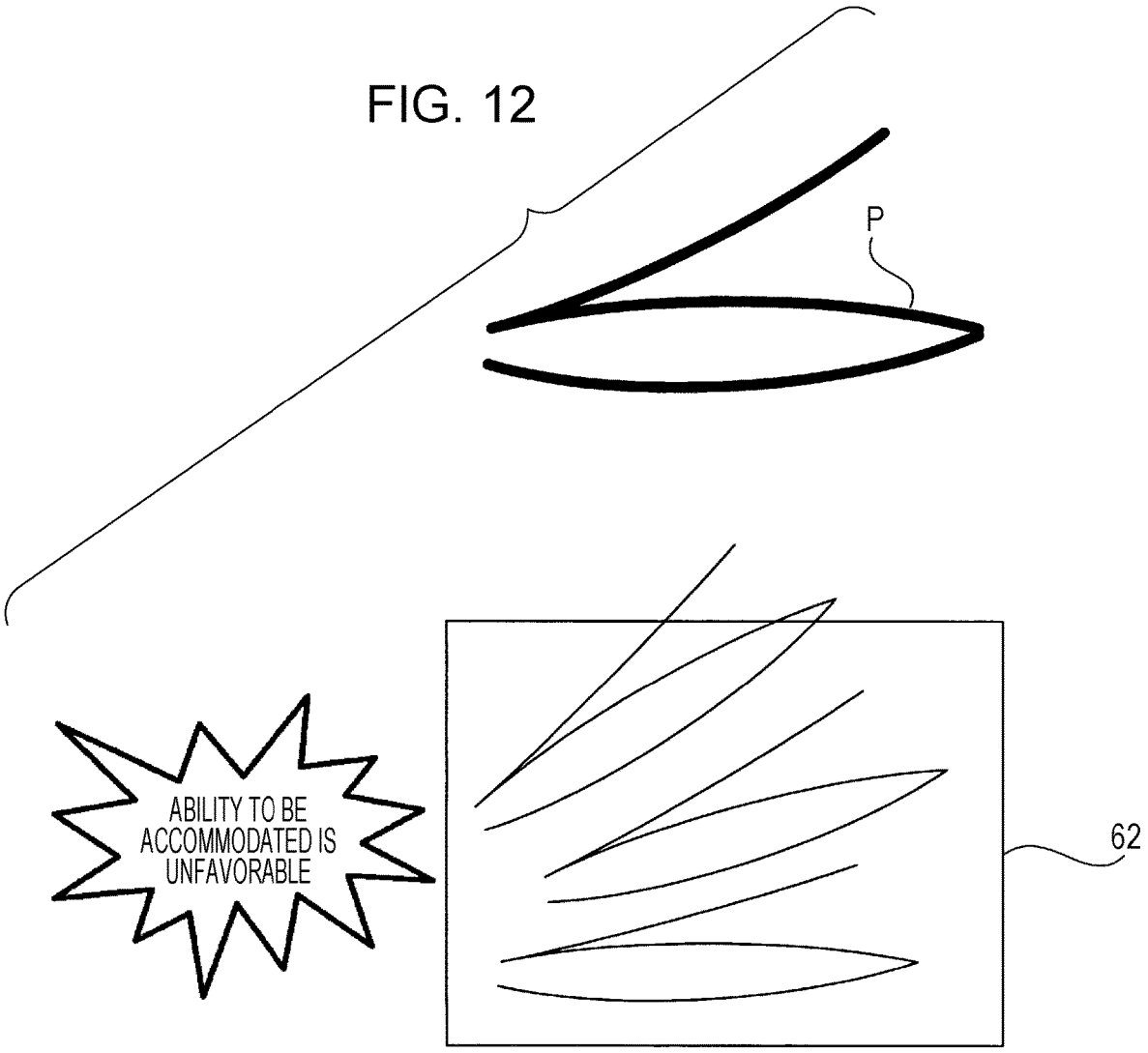
FIG. 12 is a diagram illustrating a state in which a sheet curled in one direction is accordion-folded.

FIG. 12 illustrates the case where a sheet that has been curled in one direction such as that illustrated in FIG. 7A or 7B is accordion-folded. Since one of the outer surfaces of the accordion-fold sheet is curved in a recessed manner, a force is applied to the sheet in a direction in which the sheet is opened.

Thus, when a sheet that is accordion-folded in the manner described above is ejected to the sheet-stacking device 62, the sheet is likely to unfold, and the sheet's ability to be accommodated deteriorates. In addition, when a plurality of such sheets are ejected, the sheets are stacked on top of one another in an unstable state, that is, they are brought into an unfavorable stacked state, so that a problem such as falling down of the stack of the sheets occurs. If sheets in the above-mentioned state are ejected to the ejection tray, there is a possibility that an undesirable effect such as the sheets falling from the ejection tray may be caused.

Accordingly, in the image forming system 10 of the present exemplary embodiment, when a sheet is folded by a folding method that is so-called Z fold by which a sheet is folded such that the two ends of the sheet face outward in opposite directions, the ability of the folded sheet to be accommodated is improved compared with the case where the sheet is curled in one direction.

Specifically, when folding processing is performed on a sheet such that the two ends of the sheet in the transport direction of the sheet face outward in opposite directions, the controller 41 in the present exemplary embodiment controls the decurling device 50 so as to curve the sheet in a plurality of directions with respect to a transport surface of the sheet.

More specifically, the controller 41 performs control so as to cause the decurling device 50 to curve a sheet, which is transported to the decurling device 50, such that the leading end and the trailing end of the sheet in the transport direction are curved in different directions.

In other words, the controller 41 performs control so as to cause the decurling device 50 to curve a sheet transported thereto such that the cross section of the sheet in the transport direction has an S shape.

Note that, since the decurling unit 51 has a structure such as that illustrated in FIG. 4, the controller 41 controls the decurling device 50 so as to curve a single sheet in a plurality of directions with respect to a transport surface of the sheet by switching, while the single sheet is being transported, between a pressing force that is applied by the pressing roller 81 and that causes one of the surfaces of the transported sheet to be curved in a convex manner and a pressing force that is applied by the pressing roller 82 and that causes the one surface of the transported sheet to be curved in a recessed manner.

When the pressing rollers 81 and 82 are considered as a pressing roller that presses one of the surfaces of a sheet and a pressing roller that presses the other surface of the sheet, the controller 41 controls the decurling device 50 so as to curve a single sheet in a plurality of directions with respect to a transport surface of the sheet by switching, while the single sheet is being transported, between a pressing force that is applied by the pressing roller 81 to one of the surfaces of the transported sheet and a pressing force that is applied by the pressing roller 82 to the other surface of the transported sheet.

Note that it is necessary to match folding positions of a sheet when the sheet is Z-folded with the positions at which the sheet is curved, and thus, the controller 41 controls the decurling device 50 so as to adjust the positions at which the sheet is curved in accordance with the positions at which the sheet is to be folded by the folding device 60, which is arranged downstream from the decurling device 50.

More specifically, the controller 41 may control the decurling device 50 so as to adjust the positions at which a sheet, which is transported to the decurling device 50, is curved in accordance with the size of the sheet or may control the decurling device 50 so as to adjust the length of time for curving a sheet, which is transported to the decurling device 50, in accordance with the type of the sheet.

Here, an example of the folding processing for folding a sheet such that the two ends of the sheet in the transport direction of the sheet face outward in opposite directions is folding processing for performing Z fold on a transport surface of a sheet. Note that folding processing for folding a sheet such that the two ends of the sheet in the transport direction of the sheet face outward in opposite directions other than the processing for performing Z fold will be described later, and in the following description of the present exemplary embodiment, the case where the folding device 60 performs Z fold will be described.

Operation of the image forming system 10 of the present exemplary embodiment will now be described in detail with reference to the drawings.

Figure 13:
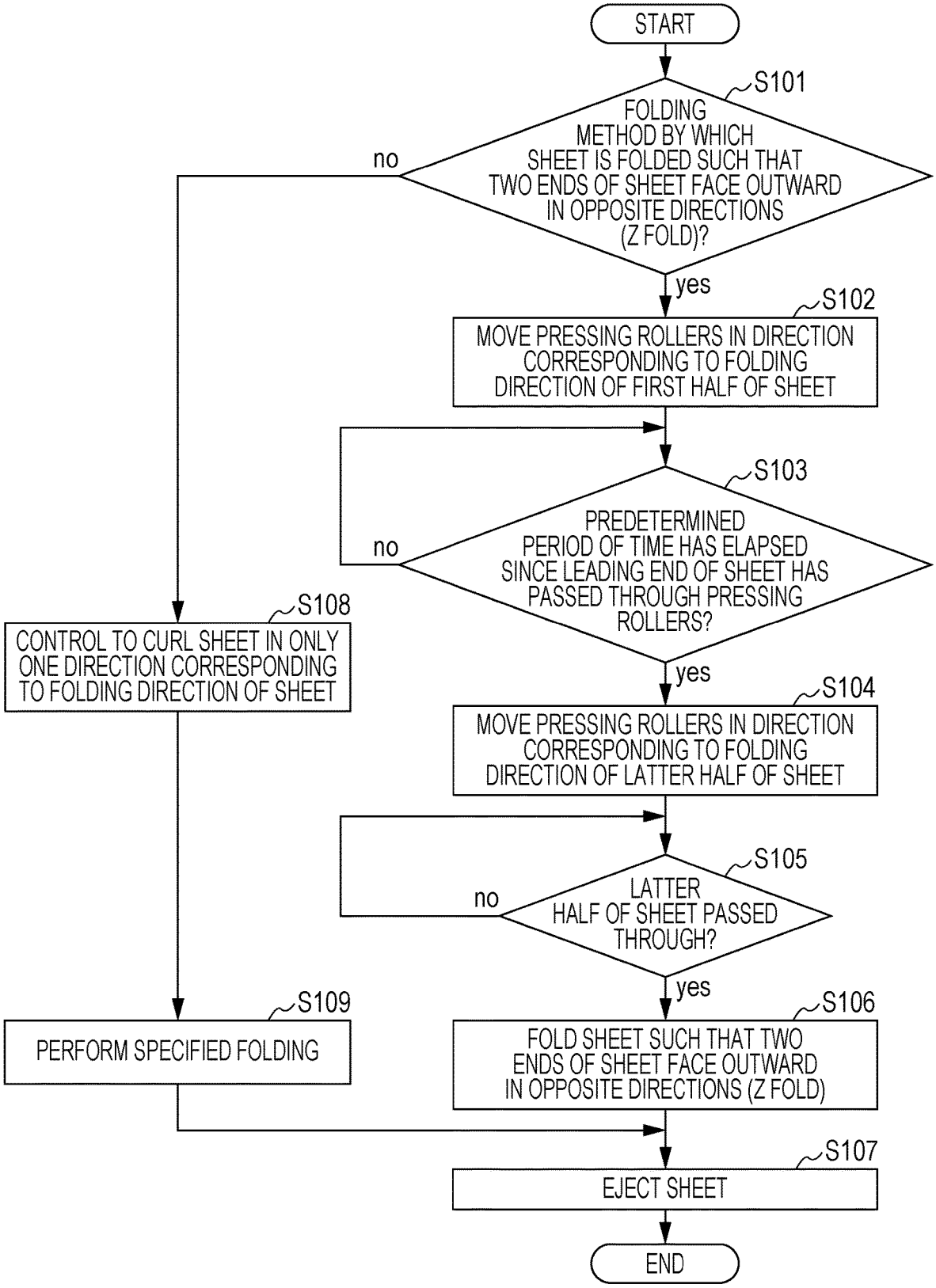
FIG. 13 is a flowchart illustrating an operation of the decurling device and an operation of the folding device in the image forming system according to the exemplary embodiment of the present disclosure.

An operation of the decurling device 50 and an operation of the folding device 60 in the image forming system 10 of the present exemplary embodiment will be described first with reference to the flowchart illustrated in FIG. 13.

First, in step S101, the controller 41 determines whether a folding method that is used in folding processing specified by a print job to be executed is a folding method by which a sheet is folded such that the two ends of the sheet face outward in opposite directions. Specifically, the controller 41 determines whether the folding method is the Z fold, which is an accordion fold.

Then, when the folding method that is used in the folding processing specified by the print job to be executed is the Z fold, the controller 41 controls, in step S102, the decurling unit 51 so as to move each of the pressing rollers 81 and 82 in a direction corresponding to the folding direction of the first half of a sheet.

When it is determined, in step S103, that a predetermined period of time has elapsed since the leading end of the sheet has passed through the pressing rollers 81 and 82, the controller 41 moves each of the pressing rollers 81 and 82 in a direction corresponding to the folding direction of the latter half of the sheet in step S104.

Then, when it is determined, in step S105, that the latter half of the sheet has passed through the decurling unit 51 and that the sheet is transported to the folding device 60, the controller 41 controls the folding processing unit 61 so as to cause the folding processing unit 61 to fold the sheet such that the two ends of the sheet face outward in opposite directions, that is, to Z-fold the sheet.

After the folding processing has been performed on the sheet in the manner described above, the sheet is ejected to the sheet-stacking device 62 in step S107.

Note that, in step S101, when the folding method that is used in the folding processing specified by the print job to be executed is not the Z fold, the controller 41 controls, in step S108, the decurling device 50 so as to curl a sheet in only one direction corresponding to a folding direction of the sheet.

Subsequently, the controller 41 controls, in step S109, the folding processing unit 61 so as to fold the sheet curled in the only one direction by a specified folding method. Note that, in step S109, the sheet is folded into a folding pattern other than a Z fold, that is, into a half fold or a C fold, which is called a letter fold.

Figure 14:
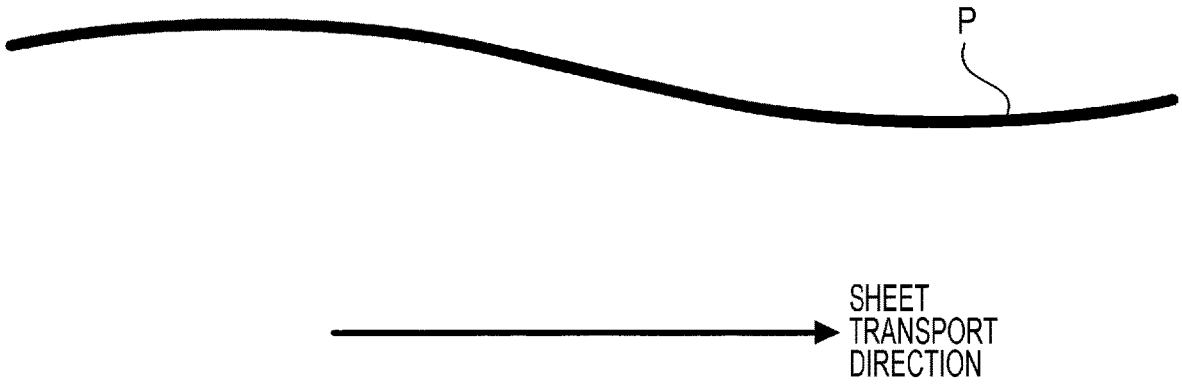
FIG. 14 is a diagram illustrating an example of a sheet that is curved by the decurling device before being Z-folded.

FIG. 14 illustrates an example of the sheet P that is curved by the decurling device 50 before the sheet P is folded into a Z fold, which is an accordion fold, by the folding device 60 as a result of the above-described control being performed. Note that the state in which the leading end and the trailing end of the sheet P in the transport direction of the sheet P are curved in different directions is illustrated as an S-shaped curl in FIG. 14.

Figure 15:
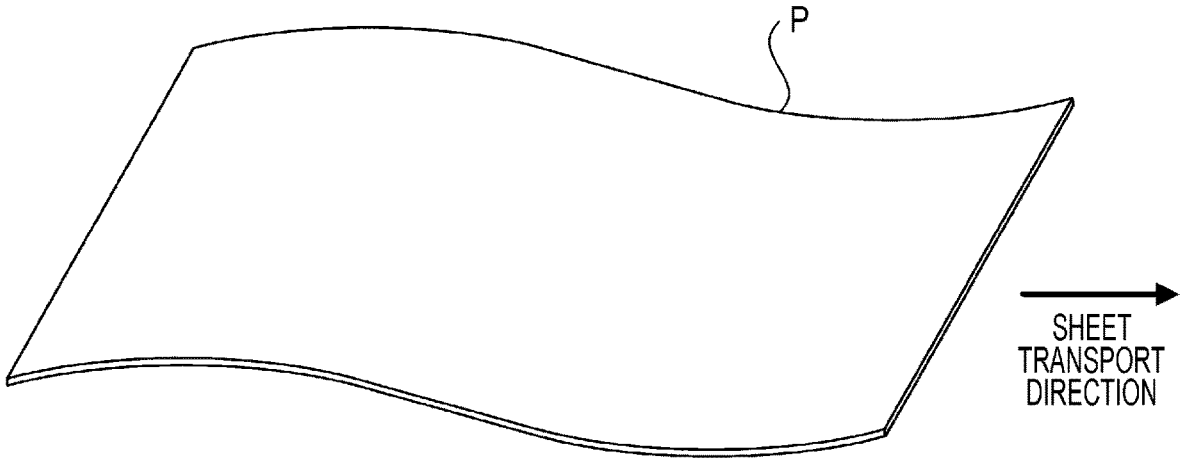
FIG. 15 is a perspective view of a sheet that is curled in an S shape such as that illustrated in FIG. 14.

FIG. 15 is a perspective view of the sheet P curled in an S shape such as that illustrated in FIG. 14. It is understood from FIG. 15 that the leading end of the sheet P in the transport direction is curled upward and that the trailing end of the sheet P is curled downward.

Figure 16A:
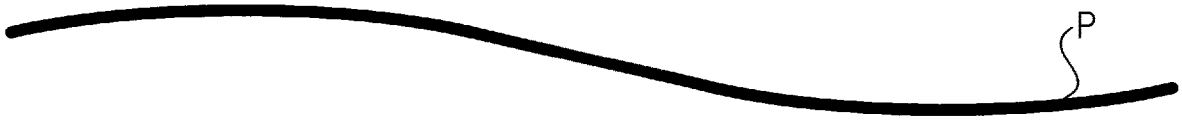
FIGS. 16A to 16C are diagrams illustrating a state in which a sheet curled in an S shape is being Z folded.
Figure 16B:
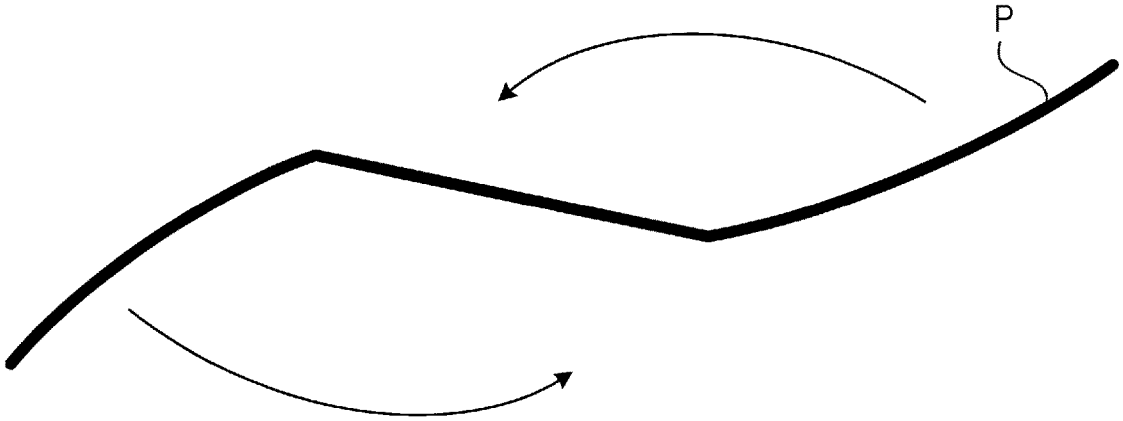
Figure 16C:
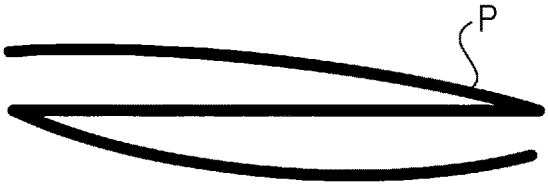

FIGS. 16A to 16C illustrate the state in which the sheet P having such an S-shaped curl is being Z-folded, or accordion-folded.

The folding device 60 performs the folding processing on the sheet P curled in an S shape such as that illustrated in FIG. 16A, so that a leading end portion and a trailing end portion of the sheet P are folded by the folding processing unit 61 as illustrated in FIG. 16B. As a result, the sheet P that is Z-folded as illustrated in FIG. 16C is ejected to the sheet-stacking device 62.

Figure 17:
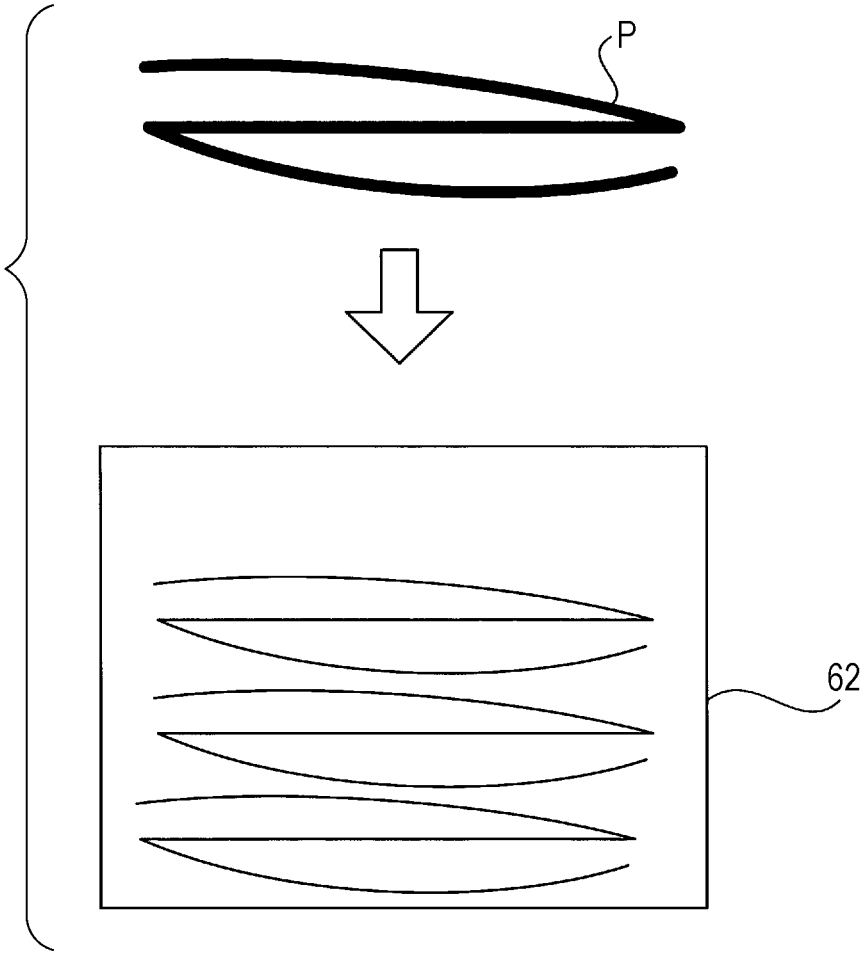
FIG. 17 is a diagram illustrating the states of sheets, which have been curled in an S shape and then Z folded, being stacked on top of one another in a sheet-stacking device.

FIG. 17 illustrates the state in which a sheet curled in an S shape in the manner described above is Z-folded and the state in which sheets that has been Z-folded are stacked in the sheet-stacking device 62.

As illustrated in FIG. 17, by curling a sheet into an S shape before the sheet is Z-folded, the two outer surfaces of the folded sheet become curved outward, and thus, a force is applied to the sheet in the direction in which the sheet is closed.

Therefore, even when sheets are Z-folded and then stacked in the sheet-stacking device 62, the sheets may be stacked on top of one another in a favorable state. It is understood from FIG. 17 that, compared with the sheets in the state illustrated in FIG. 12, the number of sheets that are stacked on top of one another per unit volume is larger, and the state of each of the sheets stacked on top of one another is more favorable.

Figure 18:
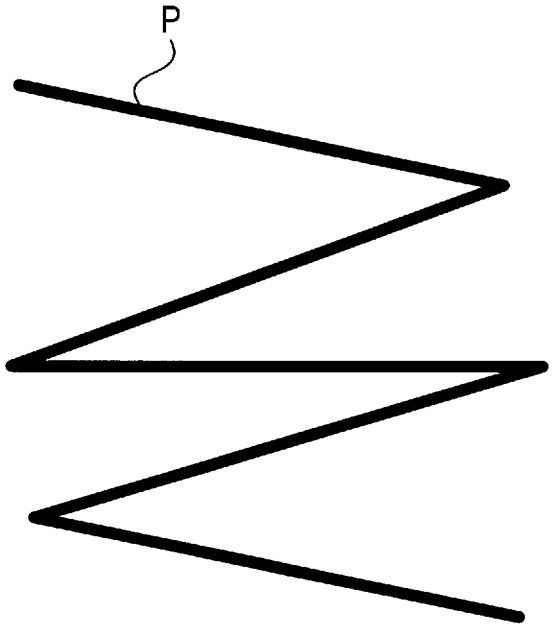
FIG. 18 is a diagram illustrating an example of a folding method, other than a Z-fold method, by which a sheet is folded such that the two ends of the sheet face outward in opposite directions.

Note that, in the above description, although the Z-fold method is used as an example of the folding method by which a sheet is folded such that the two ends of the sheet face outward in opposite directions, another example of the folding method other than the Z-fold method is illustrated in FIG. 18.

The folding method illustrated in FIG. 18 is a folding method of folding a sheet such that the sheet is divided into five portions and that the end portions of the sheet face outward in opposite directions and is called a 10-page zig-zag fold or a 10-page accordion fold. As another example of the folding method by which a sheet is folded such that the two ends of the sheet face outward in opposite directions, there is a folding method of folding a sheet such that the sheet is divided into seven portions and that the end portions of the sheet face outward in opposite directions.

Figure 19A:
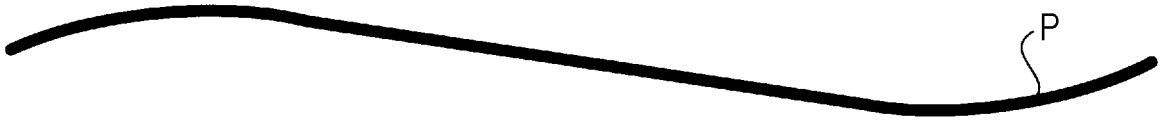
FIGS. 19A and 19B are diagrams illustrating the cases in which a sheet is curled in an S shape before the sheet is folded into 10-page zig-zag fold.
Figure 19B:
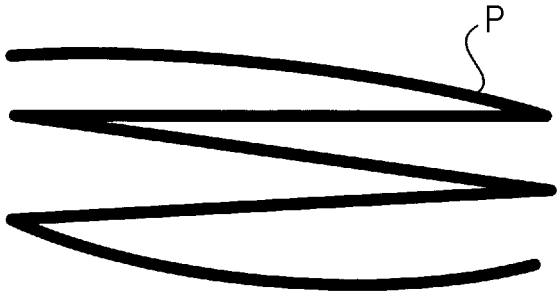

FIGS. 19A and 19B illustrate the case where a sheet is curled into an S shape before the sheet is folded into a 10-page zig-zag fold such as that illustrated in FIG. 18.

FIG. 19A illustrates an S-shaped curl given to the sheet before the sheet is folded into a 10-page zig-zag fold. FIG. 19B illustrates the state in which the sheet, which has been curled in such an S shape, is folded in a 10-page zig-zag fold.

It is understood from FIG. 19B that, also when a sheet is folded into a 10-page zig-zag fold, by giving an S-shaped curl that corresponds to the folding directions of the sheet to the sheet beforehand, a force in the direction in which the sheet is closed may be applied to the outer surfaces of the sheet.

In the embodiment above, the term "processor" refers to hardware in a broad sense. Examples of the processor include general processors (e.g., CPU: Central Processing Unit) and dedicated processors (e.g., GPU: Graphics Processing Unit, ASIC: Application Integrated Circuit, FPGA: Field Programmable Gate Array, and programmable logic device).

In the embodiment above, the term "processor" is broad enough to encompass one processor or plural processors in collaboration which are located physically apart from each other but may work cooperatively. The order of operations of the processor is not limited to one described in the embodiment above, and may be changed.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A post-processing apparatus comprising:
memory; and
a processor configured to
control a curving device that curves a sheet, which is transported to the curving device, by pressing the sheet,
control folding processing that is performed on the sheet curved by the curving device, and
control, when folding processing is performed such that two ends of the sheet in a transport direction of the sheet face outward in opposite directions after the folding processing has been performed on the sheet, the curving device so as to curve the sheet in a plurality of directions with respect to a transport surface.

2. The post-processing apparatus according to claim 1, wherein the processor is configured to the curving device so as to curve the sheet, which is transported to the curving device, such that a leading end and a trailing end of the sheet in the transport direction of the sheet are curved in different directions.

3. The post-processing apparatus according to claim 2, wherein the folding processing for folding the sheet such that the two ends of the sheet in the transport direction of the sheet face outward in opposite directions is folding processing for performing Z fold on a transport surface of the sheet.

4. The post-processing apparatus according to claim 3, wherein the processor is configured to control the curving device so as to curve a single sheet in a plurality of directions with respect to a transport surface of the single sheet by switching, while the single sheet is being transported, a pressing force that is applied by a first pressing roller and that causes one of two surfaces of the single sheet to be curved in a convex manner and a pressing force that is applied by a second pressing roller and that causes the one surface of the single sheet to be curved in a recessed manner.

5. The post-processing apparatus according to claim 3, wherein the processor is configured to control the curving device so as to curve a single sheet in a plurality of directions with respect to a transport surface of the single sheet by switching, while the single sheet is being transported, between a pressing force that is applied by a first pressing roller to one of two surfaces of the single sheet and a pressing force that is applied by a second pressing roller to another one of the two surfaces of the single sheet.

6. The post-processing apparatus according to claim 2, wherein the processor is configured to control the curving device so as to curve a single sheet in a plurality of directions with respect to a transport surface of the single sheet by switching, while the single sheet is being transported, a pressing force that is applied by a first pressing roller and that causes one of two surfaces of the single sheet to be curved in a convex manner and a pressing force that is applied by a second pressing roller and that causes the one surface of the single sheet to be curved in a recessed manner.

7. The post-processing apparatus according to claim 2, wherein the processor is configured to control the curving device so as to curve a single sheet in a plurality of directions with respect to a transport surface of the single sheet by switching, while the single sheet is being transported, between a pressing force that is applied by a first pressing roller to one of two surfaces of the single sheet and a pressing force that is applied by a second pressing roller to another one of the two surfaces of the single sheet.

8. The post-processing apparatus according to claim 1, wherein the processor is configured to the curving device so as to curve the sheet, which is transported to the curving device, such that the sheet is S-shaped when viewed in cross-section in the transport direction of the sheet.

9. The post-processing apparatus according to claim 8, wherein the folding processing for folding the sheet such that the two ends of the sheet in the transport direction of the sheet face outward in opposite directions is folding processing for performing Z fold on a transport surface of the sheet.

10. The post-processing apparatus according to claim 9, wherein the processor is configured to control the curving device so as to curve a single sheet in a plurality of directions with respect to a transport surface of the single sheet by switching, while the single sheet is being transported, a pressing force that is applied by a first pressing roller and that causes one of two surfaces of the single sheet to be curved in a convex manner and a pressing force that is applied by a second pressing roller and that causes the one surface of the single sheet to be curved in a recessed manner.

11. The post-processing apparatus according to claim 9, wherein the processor is configured to control the curving device so as to curve a single sheet in a plurality of directions with respect to a transport surface of the single sheet by switching, while the single sheet is being transported, between a pressing force that is applied by a first pressing roller to one of two surfaces of the single sheet and a pressing force that is applied by a second pressing roller to another one of the two surfaces of the single sheet.

12. The post-processing apparatus according to claim 8, wherein the processor is configured to control the curving device so as to curve a single sheet in a plurality of directions with respect to a transport surface of the single sheet by switching, while the single sheet is being transported, a pressing force that is applied by a first pressing roller and that causes one of two surfaces of the single sheet to be curved in a convex manner and a pressing force that is applied by a second pressing roller and that causes the one surface of the single sheet to be curved in a recessed manner.

13. The post-processing apparatus according to claim 8, wherein the processor is configured to control the curving device so as to curve a single sheet in a plurality of directions with respect to a transport surface of the single sheet by switching, while the single sheet is being transported, between a pressing force that is applied by a first pressing roller to one of two surfaces of the single sheet and a pressing force that is applied by a second pressing roller to another one of the two surfaces of the single sheet.

14. The post-processing apparatus according to claim 1, wherein the folding processing for folding the sheet such that the two ends of the sheet in the transport direction of the sheet face outward in opposite directions is folding processing for performing Z fold on a transport surface of the sheet.

15. The post-processing apparatus according to claim 14, wherein the processor is configured to control the curving device so as to curve a single sheet in a plurality of directions with respect to a transport surface of the single sheet by switching, while the single sheet is being transported, a pressing force that is applied by a first pressing roller and that causes one of two surfaces of the single sheet to be curved in a convex manner and a pressing force that is applied by a second pressing roller and that causes the one surface of the single sheet to be curved in a recessed manner.

16. The post-processing apparatus according to claim 14, wherein the processor is configured to control the curving device so as to curve a single sheet in a plurality of directions with respect to a transport surface of the single sheet by switching, while the single sheet is being transported, between a pressing force that is applied by a first pressing roller to one of two surfaces of the single sheet and a pressing force that is applied by a second pressing roller to another one of the two surfaces of the single sheet.

17. The post-processing apparatus according to claim 1, wherein the processor is configured to control the curving device so as to curve a single sheet in a plurality of directions with respect to a transport surface of the single sheet by switching, while the single sheet is being transported, a pressing force that is applied by a first pressing roller and that causes one of two surfaces of the single sheet to be curved in a convex manner and a pressing force that is applied by a second pressing roller and that causes the one surface of the single sheet to be curved in a recessed manner.

18. The post-processing apparatus according to claim 1, wherein the processor is configured to control the curving device so as to curve a single sheet in a plurality of directions with respect to a transport surface of the single sheet by switching, while the single sheet is being transported, between a pressing force that is applied by a first pressing roller to one of two surfaces of the single sheet and a pressing force that is applied by a second pressing roller to another one of the two surfaces of the single sheet.

19. An image forming system comprising:

memory; and a processor configured to perform control in such a manner that an image forming apparatus forms an image on a sheet, control a curving device that curves the sheet, which is transported to the curving device after the image has been formed on the sheet, by pressing the sheet, control folding processing that is performed on the sheet curved by the curving device, and control, when folding processing is performed such that two ends of the sheet in a transport direction of the sheet face outward in opposite directions after the folding processing has been performed on the sheet, the curving device so as to curve the sheet in a plurality of directions with respect to a transport surface.

20. A post-processing apparatus comprising:

memory means; and means for controlling a curving device that curves a sheet, which is transported to the curving device, by pressing the sheet, means for controlling folding processing that is performed on the sheet curved by the curving device, and means for controlling, when folding processing is performed such that two ends of the sheet in a transport direction of the sheet face outward in opposite directions after the folding processing has been performed on the sheet, the curving device so as to curve the sheet in a plurality of directions with respect to a transport surface.

* * * * *